US010550533B2

(12) United States Patent
Currie

(10) Patent No.: US 10,550,533 B2
(45) Date of Patent: Feb. 4, 2020

(54) BAG AND HAND PROTECTOR COMBINATION FOR SANITARY WASTE OR SPECIMEN COLLECTION

(71) Applicant: Michael Lee Currie, Winnipeg (CA)

(72) Inventor: Michael Lee Currie, Winnipeg (CA)

( * ) Notice: Subject to any disclaimer, the term of this patent is extended or adjusted under 35 U.S.C. 154(b) by 0 days.

(21) Appl. No.: 16/180,246

(22) Filed: Nov. 5, 2018

(65) Prior Publication Data

US 2019/0194890 A1 Jun. 27, 2019

Related U.S. Application Data

(60) Provisional application No. 62/584,391, filed on Nov. 10, 2017.

(51) Int. Cl.
*E01H 1/12* (2006.01)
*B65F 1/00* (2006.01)

(52) U.S. Cl.
CPC ..... *E01H 1/1206* (2013.01); *B65F 1/0006* (2013.01); *B65F 2240/136* (2013.01)

(58) Field of Classification Search
CPC ..... E01H 1/1206; B65F 1/0006
USPC ..... 294/1.3, 1.4, 1.5
See application file for complete search history.

(56) References Cited

U.S. PATENT DOCUMENTS 5,438,708 A * 8/1995 Jacovitz ..... A41D 19/0075 15/227
5,671,983 A * 9/1997 Miller ..... B08B 15/026 206/438
5,704,670 A * 1/1998 Surplus ..... A41D 19/0075 2/159
6,050,726 A * 4/2000 Hoerl ..... A41D 19/0075 294/1.3
6,230,080 B1 * 5/2001 Lee ..... G01N 1/24 700/275
6,305,843 B1 * 10/2001 Helmer ..... A41D 19/0075 206/278
9,957,677 B2 * 5/2018 Johnson ..... E01H 1/1206
2011/0210571 A1 * 9/2011 Dan ..... A41D 19/0024 294/1.3
2013/0223970 A1 * 8/2013 Surber ..... E01H 1/1206 414/800
2014/0265381 A1 * 9/2014 Joseph-de Saram ..... E01H 1/1206 294/1.3

* cited by examiner

*Primary Examiner* — Paul T Chin
(74) *Attorney, Agent, or Firm* — Kyle R Satterthwaite; Ryan W Dupuis; Ade & Company Inc.

(57) ABSTRACT

A device for sanitary collection of materials features a bag having a closed bottom end, side walls that extend from the closed bottom end to delimit a collection space above the closed bottom end, and a hand protector that is attached to one of said side walls and has a hollow interior that is open or openable at one end to enable insertion of one's hand into the hand protector. A handle is provided in an opposing side wall so that that bag can be suspended in an open state between a wrist or forearm on which the hand protector is worn, and the hand of the user's opposite arm. A stamping operation performed on a continuous plastic web is operable to efficiently create the bag and hand protector as integral parts of a unitary bag construction.

20 Claims, 9 Drawing Sheets

BAG AND HAND PROTECTOR COMBINATION FOR SANITARY WASTE OR SPECIMEN COLLECTION

CROSS-REFERENCE TO RELATED APPLICATIONS

This application claims benefit under 35 U.S.C. 119(e) of U.S. Provisional Application No. 62/584,391 filed Nov. 10, 2017, the entirety of which is incorporated herein by reference.

FIELD OF THE INVENTION

The present invention relates generally to devices for hand-picked collection of waste or specimen materials, and more particularly to collection device featuring a bag with a hand protector attached to one side wall thereof to cover one's hand during pickup of waste or specimen material for collection in said bag.

BACKGROUND

It has been previously proposed to incorporate a protective glove into a waste collection bag so that pet droppings, other unpleasant waste material or touch-sensitive specimens (e.g. crime scene evidence) can be hand-picked from the ground and collected inside the bag in a sanitary manner with the user's hand protected by the glove. Examples of such bag-glove combinations can be found in U.S. Pat. Nos. 4,964,188, 5,301,806, 5,438,708, 5,704,670, 6,050,726, 6,116,668, 6,237,971, 6,539,549, 8,641,108 and USD445963; and in Published U.S. Patent Applications US20080244807, US20100084880. Other reference combining bags or containers with pickup gloves or other collection/cleanup tools include U.S. Pat. Nos. 6,536,132, 6,832,796, 8,672,372 and 9,516,864; and Published U.S. Patent Applications US20120299317 and US20150122822.

However, there remains room for improved and alternative designs.

SUMMARY OF THE INVENTION

According to one aspect of the invention, there is provided a device for sanitary collection of materials, said device comprising a bag having a closed bottom end, and side walls that extend from the closed bottom end to delimit a collection space between said walls above the closed bottom end of the bag, and a hand protector that is attached to one of said side walls and has a hollow interior that is open or openable at one end to enable insertion of one's hand into said hollow interior of the hand protector, wherein said one of the side walls to which the hand protector is attached is a taller side wall that reaches a greater height from the closed bottom of the bag than a lesser height possessed by at least one other of said side walls, and the hand protector is attached to said taller one of the side walls at an elevation thereon that exceeds said lesser height possessed by said at least one other of said side walls.

According to another aspect of the invention, there is provided a device for sanitary collection of materials, said device comprising a bag having a closed bottom end, and side walls that extend from the closed bottom end to delimit a collection space between said side walls above the closed bottom end of the bag, and a hand protector attached to a first one of said side walls and comprising a hollow interior that is open or openable at one end to enable insertion of one's hand into said hollow interior of the hand protector, and a handle in a second one of the side walls that resides opposite said first one of the side walls.

According to another aspect of the invention, there is provided a device for sanitary collection of materials, said device comprising a bag having a closed bottom end, and side walls that extend from the closed bottom end to delimit a collection space between said side walls above the closed bottom end of the bag, and a hand protector attached to a first one of said side walls and comprising a hollow interior that is open or openable at one end to enable insertion of one's hand into said hollow interior of the hand protector, wherein the bag and the hand protector are integral parts of a unitary bag construction having a stamped void area therein, of which one sealed boundary region defines a closed seam of the hand protector, and an unsealed boundary region defines an open upper end of the collection space.

According to yet another aspect of the invention, there is provided a method of using a sanitary collection device that comprises a bag and a hand protector attached to a first side wall of said bag, said method comprising suspending the bag in an open state between a wrist or forearm area on a first arm of a user on which the hand protector is worn and a hand of a second arm of the user that grips a handle of the bag at a second side of the bag situated opposite the first side of the bag, and using an upper part of said first side wall of the bag to which the hand protector is attached as an extension to reach downwardly past an elevation occupied by a top end of at least one shorter side wall of the bag to ground level to retrieve material therefrom, and then pulling said material back up past said top end of said at least one shorter side wall to dump said retrieved material into the collection space.

BRIEF DESCRIPTION OF THE DRAWINGS

Preferred embodiments of the invention will now be described in conjunction with the accompanying drawings in which.

DETAILED DESCRIPTION

Figure 1:
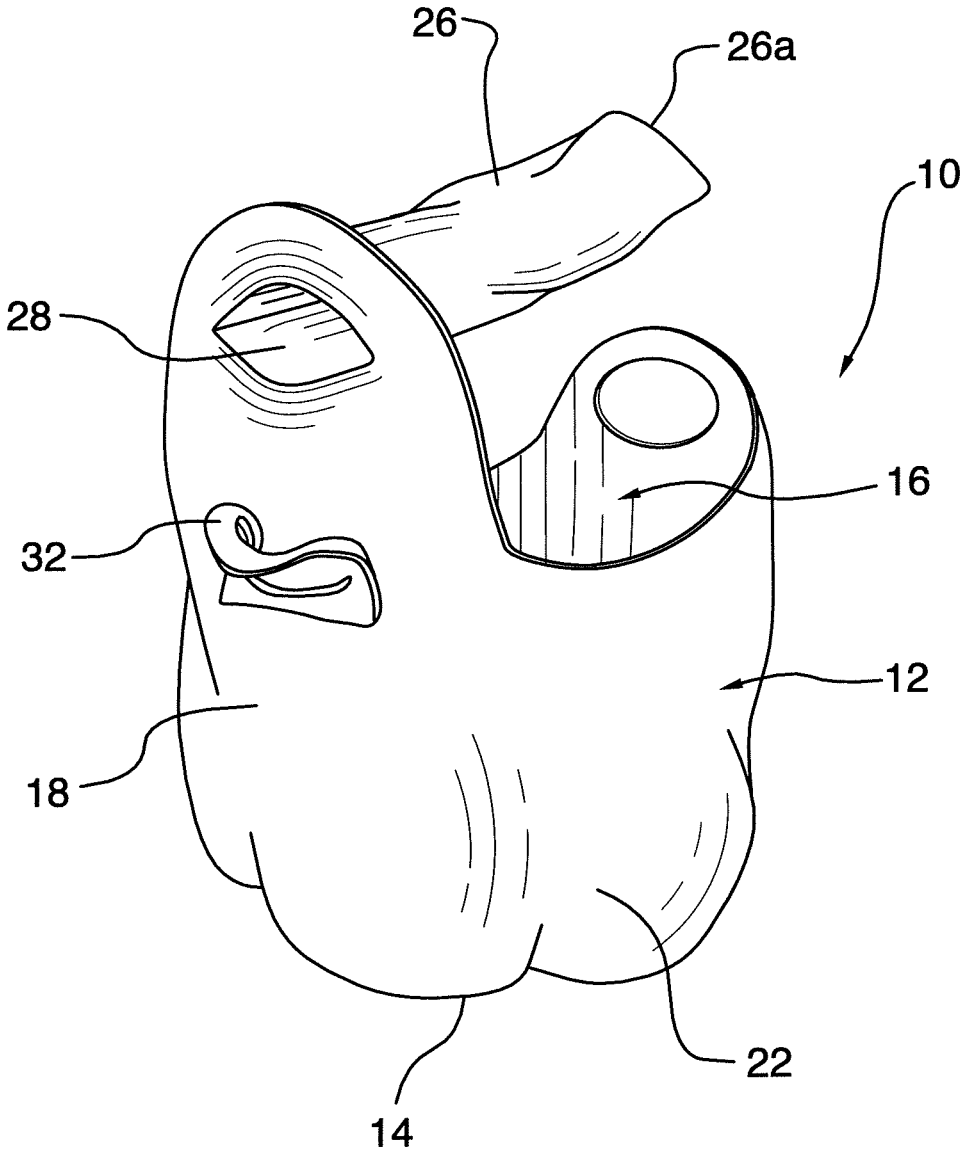
FIG. 1 is a side perspective view of a sanitary collection device according to a first embodiment of the present invention featuring a combined bag and hand protector, as viewed from a first taller side of the bag with the hand protector raised into a useful working position.

FIG. 1 shows a combined bag and hand protector device 10 for sanitary collection of unpleasant waste material (e.g. pet droppings), touch-sensitive specimens (e.g. crime scene evidence) or other materials that a collector either cannot, or would prefer not to, touch with their hands. The device 10 features a bag 12 having a bottom wall defining a closed bottom end 14 of the bag, and a set of four side walls that stand upright from the bottom wall at four respective perimeter edges thereof so that the side walls collectively span the full perimeter of the bottom wall to delimit a collection space 16 between the four side walls above the closed bottom end 14 of the bag 12. The expression "side walls" is used to denote portions of the bag that reside at different sides thereof, regardless of whether those particular portions are seamlessly integral with one another or are distinguishable from one another by a seam or other discernable border between them.

The four walls include a taller first side wall 18 at a first side of the bag, a shorter second side wall 20 residing oppositely of the taller first side wall 18 across the collection space 16 at a second side of the bag, and front and rear walls 22, 24 that reside opposite one another across the collection space 16 at the remaining third and fourth sides of the bag. The front and rear walls 22, 24 each span between the first and second side walls 18, 20 so that the side walls cooperably close around a full circumference of the collection space. The first side wall 18 is the tallest, spanning a greater height from the closed bottom end 12 of the bag than any other of the side walls. The shorter second side wall 20 is the second tallest, being shorter than the taller first side wall 18, but slightly taller than the front third wall 22 and fourth rear wall 24, which are of equal height to one another.

Figure 4:
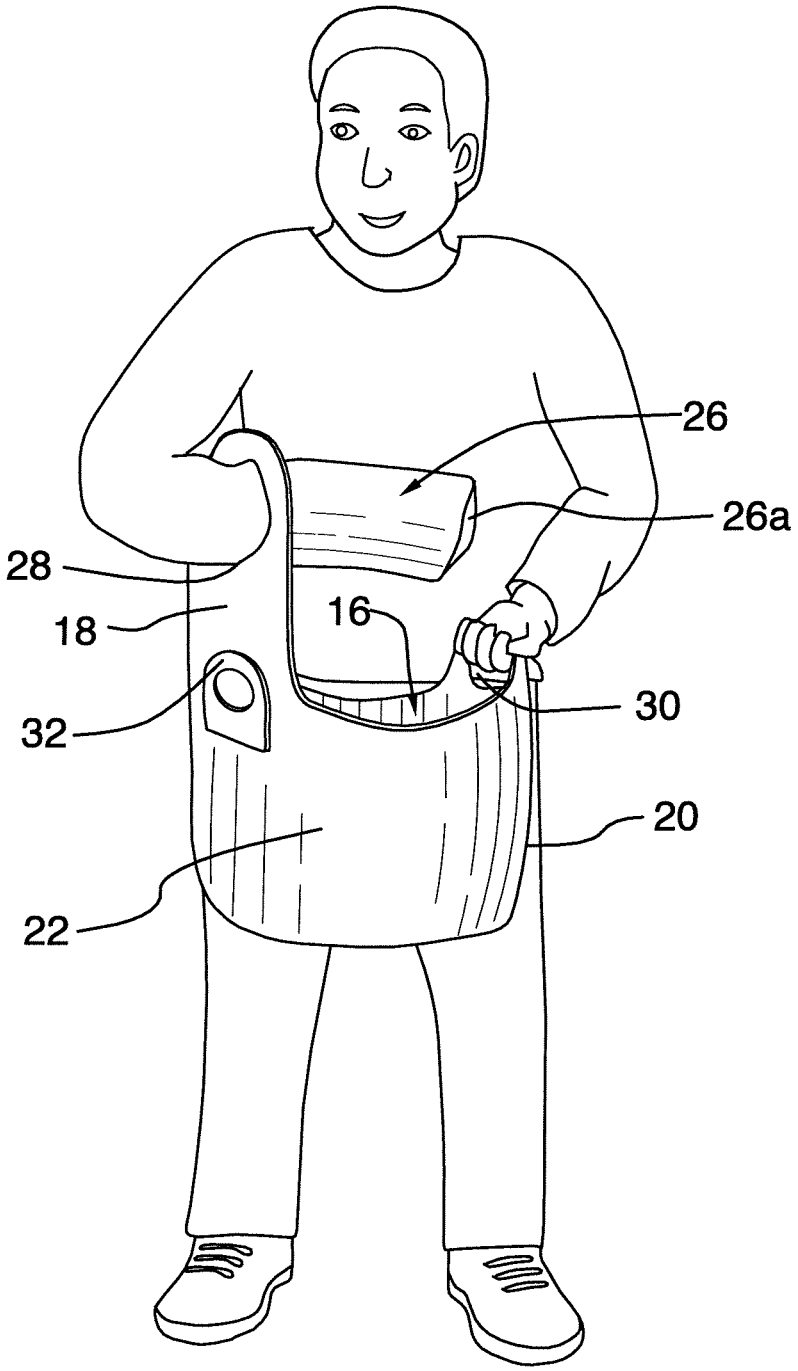
FIG. 4 is a front side perspective view of the sanitary collection device of FIG. 1 while held in a ready position by a user.

A hand protector 26 is attached to the taller first side wall 18 at an inner side thereof that faces the interior collection space 16 of the bag. More specifically, the hand protector 26 is attached to the taller first side wall near the top end thereof at an elevated height situated above the top ends of the other three side walls. In the first illustrated embodiment, the hand protector 26 is a sock-like flexible sleeve having a hollow interior, a proximal end of which terminates at an opening 28 in the taller first side wall 18 so that the hollow interior of the sleeve communicates with an exterior of the bag through the opening 28 in the taller first side wall 18. The sleeve is attached to the taller first side wall 18 around the opening 28, for example by a heat-sealed seam made between the preferably plastic sleeve and the first side wall 18 of the preferably plastic bag around the opening 28. At a distal end 26*a* of the sleeve opposite its attachment to the taller first wall 18 of the bag 12, the sleeve is closed. A user can insert one hand into in the hollow interior space of the sleeve from the outside of the bag through the opening 28 in the taller first side wall 18, as shown in FIG. 4.

The shorter second side wall 20 features a handle opening 30 therein near the top end of this second side wall. Due to the shorter height of the second side wall compared to the taller first side wall, though placed near the top end of the shorter second side wall, the handle opening 30 resides at a lower elevation from the closed bottom end of the bag than the hand protector 26 on the taller first side wall. As shown in FIG. 4, the user's second hand can thus grip the bag at the top of the shorter second side through the handle opening 30 at a location generally opposite, but lower than, the opening 28 in the first side wall through the first arm of the user reaches into the hand protector 26. In the illustrated ready position of FIG. 4, the taller first side wall 18 of the bag hangs from the wrist or forearm of the user's first arm, while the shorter second side wall 20 hangs from the fingers of the second hand that are wrapped through the handle opening 30. The first and second sides of the bag are thus supported in horizontally spaced relation from one another by the user's arms in order to keep the bag open at the top end of the collection space 16 that is bound by the four side walls.

Figure 2:
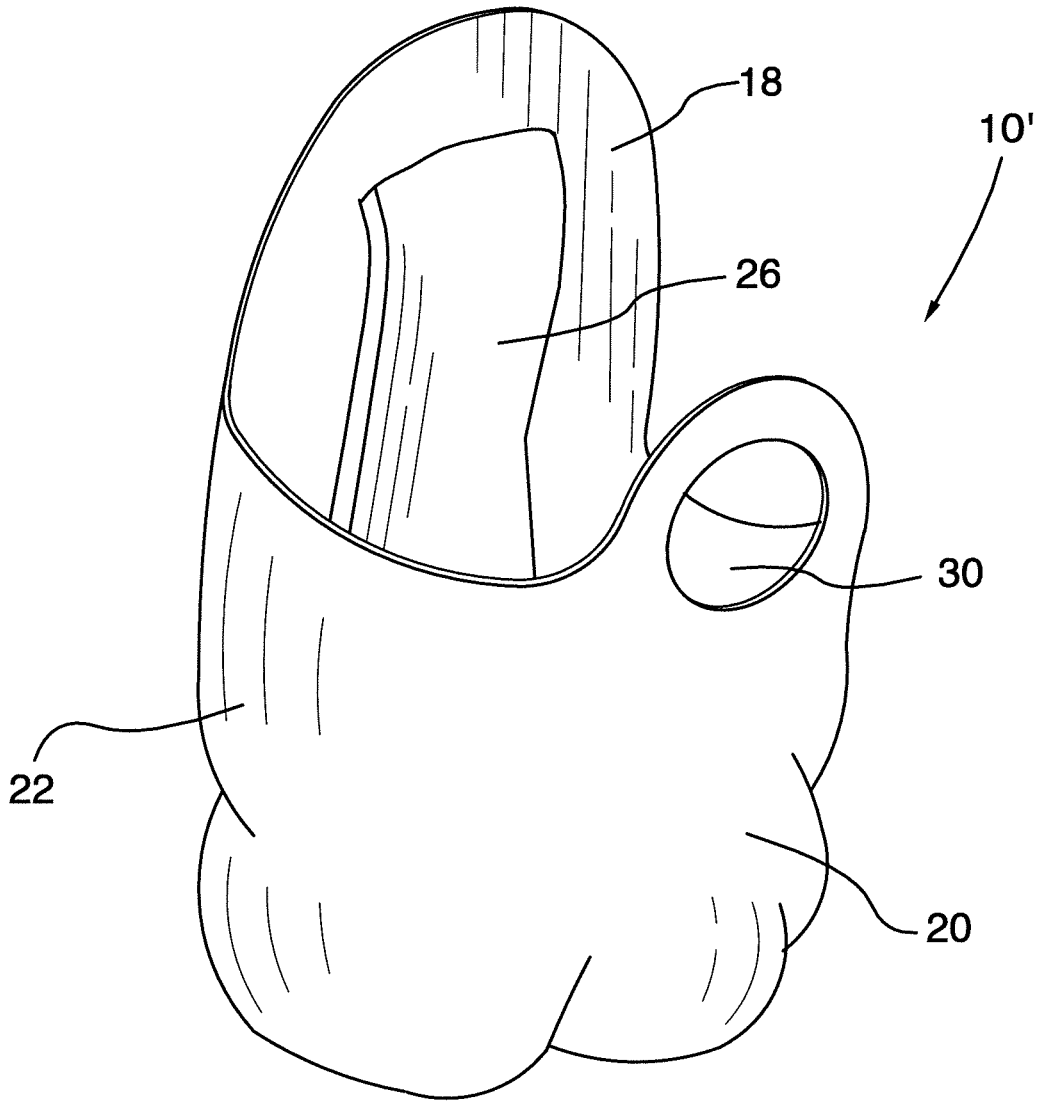
FIG. 2 is another side perspective view of the sanitary collection device of FIG. 1, as viewed from a shorter second side of the bag with the hand protector in a relaxed hanging position.
Figure 3:
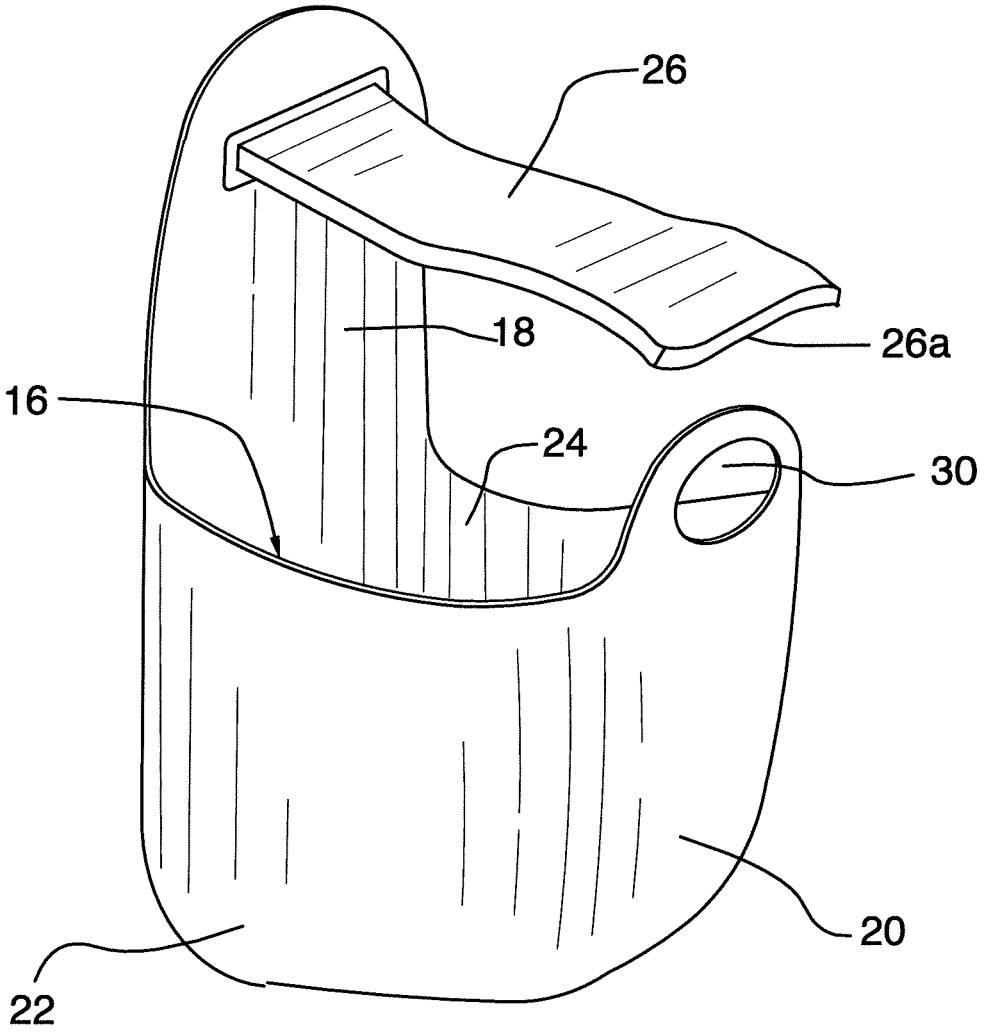
FIG. 3 is another side perspective view of the sanitary collection device of FIG. 2 from the shorter second side thereof, but with the hand protector in the useful working position of FIG. 1.

As best shown in FIG. 2, where the sleeve of the hand protector 26 is hanging in a relaxed state along the inner surface of the first side wall 18, the length of the hand protector 26 from the open proximal end thereof to the closed distal end of the sleeve exceeds the distance from the open proximal end of the sleeve to the top ends of the front and rear side walls 22, 24. The hand protector therefore 26 reach downwardly into the collection space of the bag when left to hang in a relaxed state. This way, when the user's first hand is fully inserted into the hand protector 26 to occupy the closed distal end 26*a* thereof, the sleeve-covered hand of the user is able to reach downwardly into the collection space 16 of the bag to safely drop hand-picked materials onto the bottom wall of the bag, whose topside defines the floor of the collection space 16. The hand protector 26 may be sufficiently long to reach fully down to the floor of the collection space in the relaxed hanging state of the sleeve.

On the taller first side wall 18, the bag also features an auxiliary handle 32 at a distance downward from the opening 28 of the hand protector 26, preferably at an elevation that matches the handle opening 30 in the shorter second side wall 20. In the first illustrated embodiment, the auxiliary handle 32 is a separate handle loop attached to the outer surface of the first side wall 18, rather than a handle opening passing through the first side wall 18. However, other embodiments may employ an auxiliary handle opening in the first side wall. Like the hand protector 26, this auxiliary handle loop may be formed of plastic, and thus may be heat-sealed to a constituent plastic of the bag 12 that forms the side walls thereof.

Figure 5:
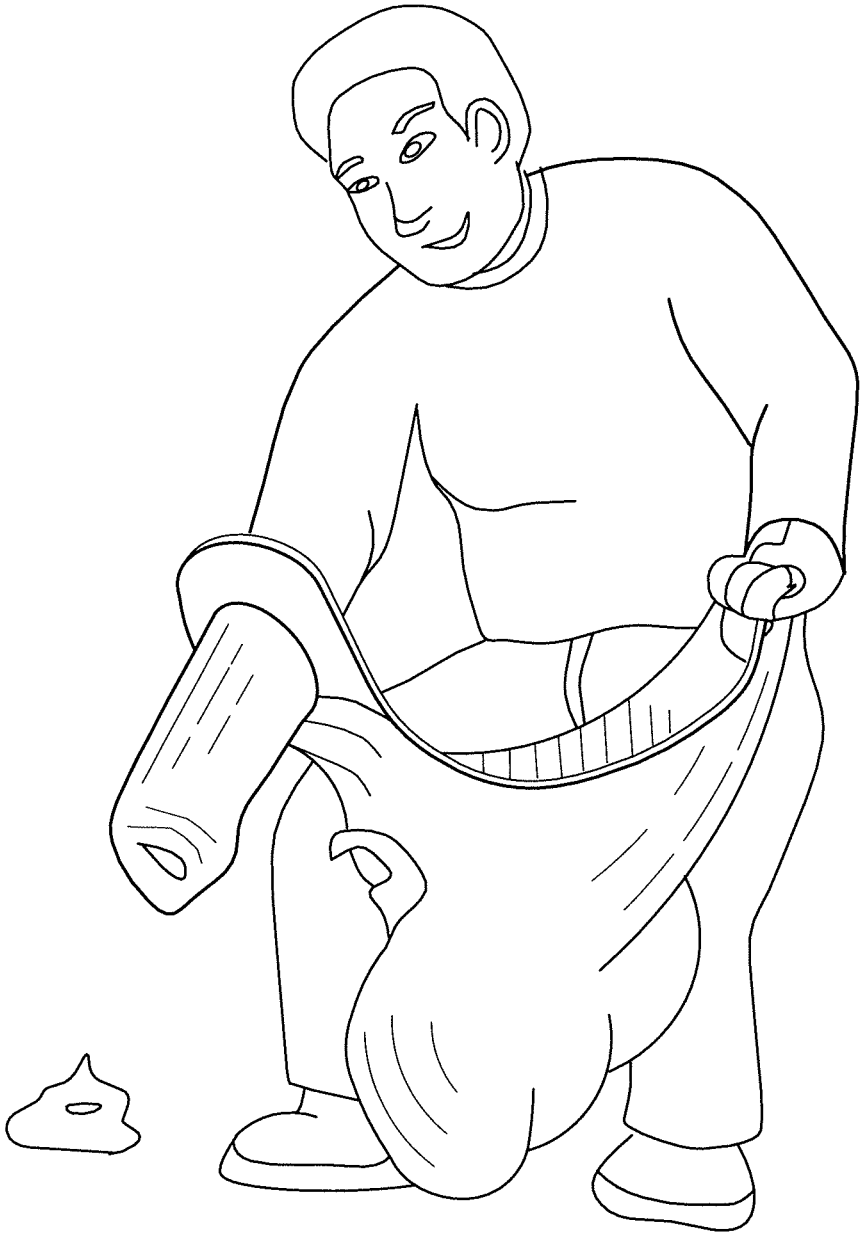
FIG. 5 is a front side perspective view of the sanitary collection device of FIG. 1 during use thereof for sanitary hand-picked collection of waste material.

To ready the device 10 for use, the user adopts the arm-worn position ready position shown in FIG. 4, where the hand of one arm is inserted into the hand protector 26 via the opening 28 in the taller first side wall 18. The first side wall 18 of the bag is slid over the hand of this first arm toward the user's elbow, until the user's hand reaches the closed distal end 26*a* of the hand protector 26. Depending on the length of the hand protector, this full insertion of the hand may place the first side wall 18 of the bag in a position hanging from the user's wrist, or hanging from a forearm area situated further up the arm from the inserted hand. With the first side wall 18 of the bag thus hanging from the wrist or forearm area of the user's first arm, the opposing second side wall 20 of the bag is supported by the user's other hand using the handle opening 30. Though the first illustrated embodiment uses a handle opening defined directly in the second side wall of the bag as primary support handle, a separate handle loop may alternatively be attached thereto, for example in a similar manner to the auxiliary handle 32, but in a position where the loop of the primary support handle can reach up past the top end of the second side wall 20 of the bag. Turning to FIG. 5, while continuing to support the shorter second side 20 of the bag in one uncovered hand using the primary support handle 30, the user's other hand is covered inside the hand protector 26 and therefore used to pickup pet waste 34 or other material from the ground.

During this process, the fact that the hand protector 26 is attached to an upper part of the taller first side wall 18 of the bag means that this upper part of the first side wall serves as an extension of the bag that can be pulled, twisted and turned in various directions relative to the open top of the bag's collection space 16, as delimited between the lower part of the first side wall and the three other shorter side walls. This upper extension portion of the bag's first side wall thus allows the user's covered hand inside the hand protector 26 to reach down to the ground at different areas around the bag, while the remainder of the bag remains open and upright with the top of the collection space opening upwardly between the wrist or forearm of the user's first arm and the bag-gripping hand of the user's second arm.

The user can thus retrieve multiple pieces or handfuls of material on a one-by-one basis from a ground area by using the sleeve-covered first hand to pick up each individual piece/handful, dropping that piece/handful into the open-top of the collection space and repeating this pick and drop process until either the ground area is fully cleaned, or the collection space of the bag has reached capacity. So unlike prior pet-waste bag/glove designs where the glove is accessed from inside the bag, and the bag must then be inverted to capture the hand-picked waste inside the bag, the device of the present invention is well suited to collection of multiple handfuls of pet-waste, for example as would be necessary to clean a pet owner's yard space on a periodic basis.

Once the collection process is complete, the hand protector 26 is slid off the user's first arm, and together with the upper extension portion of the bag's taller first side wall 18, the hand protector 26 is folded down over or into the collection space 16 of the bag. The auxiliary handle 32 and primary support handle 30 are then folded toward one another over the open top end of the collection space 16, and are tied together to close off the collection space 16 and thus secure the collected material inside the bag. In instances where the device is used for waste collection, the entire device and the material collected therein is then disposed of in a suitable waste receptacle.

While the first illustrated embodiment uses an auxiliary handle loop as a tie member for the tied closing of the bag after the collection of material therein, other styles of tie members may be employed, whether useable as an auxiliary handle or not. However, the use of an auxiliary handle provides the benefit that the bag can optionally be carried in two-handed fashion to another location using the primary support handle and the auxiliary handle prior to tying closed the bag. Also, while the first illustrated embodiment uses a sock-like fingerless sleeve for the hand protector 26, where the interior space of the hand protector is a singular undivided space that does not conform to the fingers of the user's inserted hand, other embodiments may employ a glove-shaped hand protector with individual finger spaces delimited at the closed distal end of the hand protector for improved manual dexterity during the hand-picked collection process.

Figure 6:
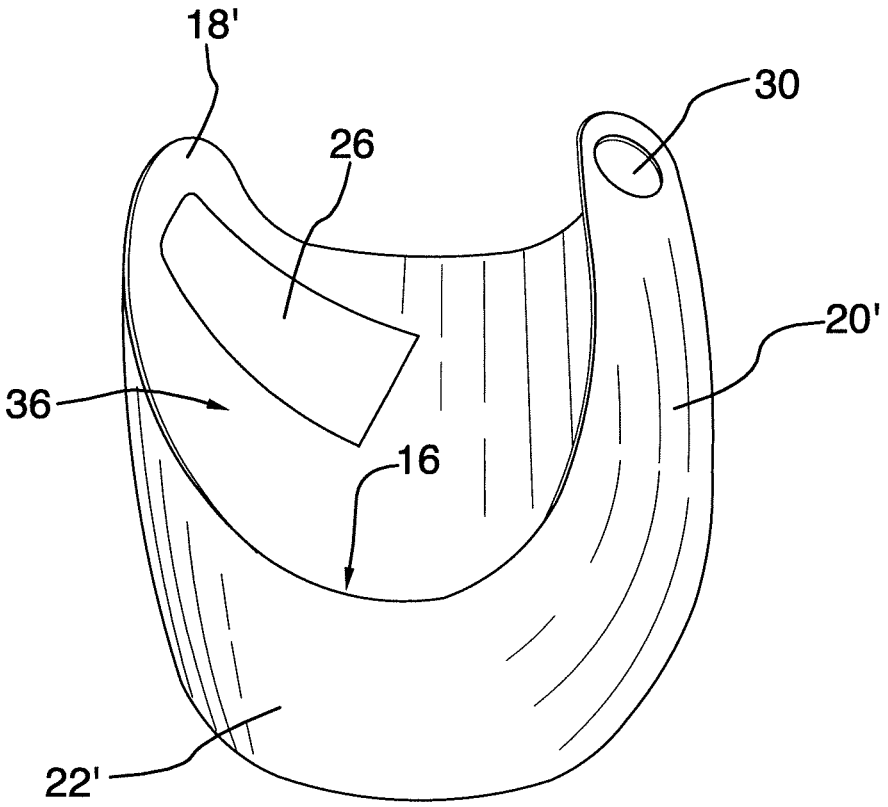
FIG. 6 is a front side perspective view of a variant of the sanitary collection device of FIG. 1.

FIG. 6 shows a variant of the device 10', where instead of the first side wall being notably taller than all other side walls of the bag, the opposing first and second side walls 18', 20' are equal or comparable in height, while the fourth rear side wall 24' is also comparable in height to the first and second side walls, though slightly shorter in the particularly illustrated example. The third front side wall 22' on the other hand is a reduced wall of notably lesser height than the other three walls however, thus forming an effective cut-out 36 at the front side of the bag at an upper half thereof. As shown, the top end of the reduced-height front side wall 22' may be curved to form a rounded-bottom scoop-shaped cut-out 36. The hand protector 26 is attached to the first side wall at a greater elevation than the scooped top end of the reduced front side wall 22'. So the first side wall to which the hand protector is attached is once again taller than at least one of the other side walls to form an extension by which the hand protector can be manipulated to reach down to the ground in different directions, while the collection space 16 delimited between the reduced front wall 22' and the bottom halves of the three taller walls remains in a usable upwardly-open orientation to enable dumping of the collected material into the collection space by the collection hand safety covered inside the hand protector.

In one mode of use, the user of the variant 10' can turn to face different directions, in each of which the protected hand can reach forwardly over the reduced front wall 22' of the collection space to pick up materials from the ground, before pulling the materials back over the reduced front wall to the open top of the collection space, where the material is then dropped safely to the floor of the collection space. Throughout the process, the bag once again remains in an upright, upwardly-open, non-inverted state suspended between the wrist or forearm area of one arm and the handle-gripping hand of the other arm, enabling collection of multiple handfuls of material in the single bag. While the illustrated device in FIG. 6 has only the front side thereof configured with the reduced height, the opposing rear side wall may likewise be of reduced height relative to the first and second side walls to make the bag ambidextrous, whereby regardless of which hand is placed in the protector, a reduced side wall is provided at the "front" of the bag that faces away from the user's body.

While the hand protector of the first illustrated embodiment in FIGS. 1 to 6 is seamed to the bag wall fully around the open end of the hand protector so that the open end of the hand protector defines an opening in the side wall through which the user's hand is inserted, other embodiments may have the hand protector attached in another manner that doesn't open through the side wall of the bag. For example, the hand protector may be seamed or otherwise joined to the bag wall on only one side of the hand protector's open end, in which case the user's hand is insertable through this open end of the hand protector without passing through the side wall of the bag.

To help hold the hand protector in place on the user's wrist or forearm, an elastic band, drawstring or other type of self-tightening or user-tightenable cuff may be included to constrict the hand protector around the user's wrist or forearm near the open end of the hand protector, or at some intermediate location between the open and closed ends thereof. This would help prevent the hand-protector from sliding off the user's hand, and thus prevent the protector-equipped first side of the bag from falling.

Figure 7:
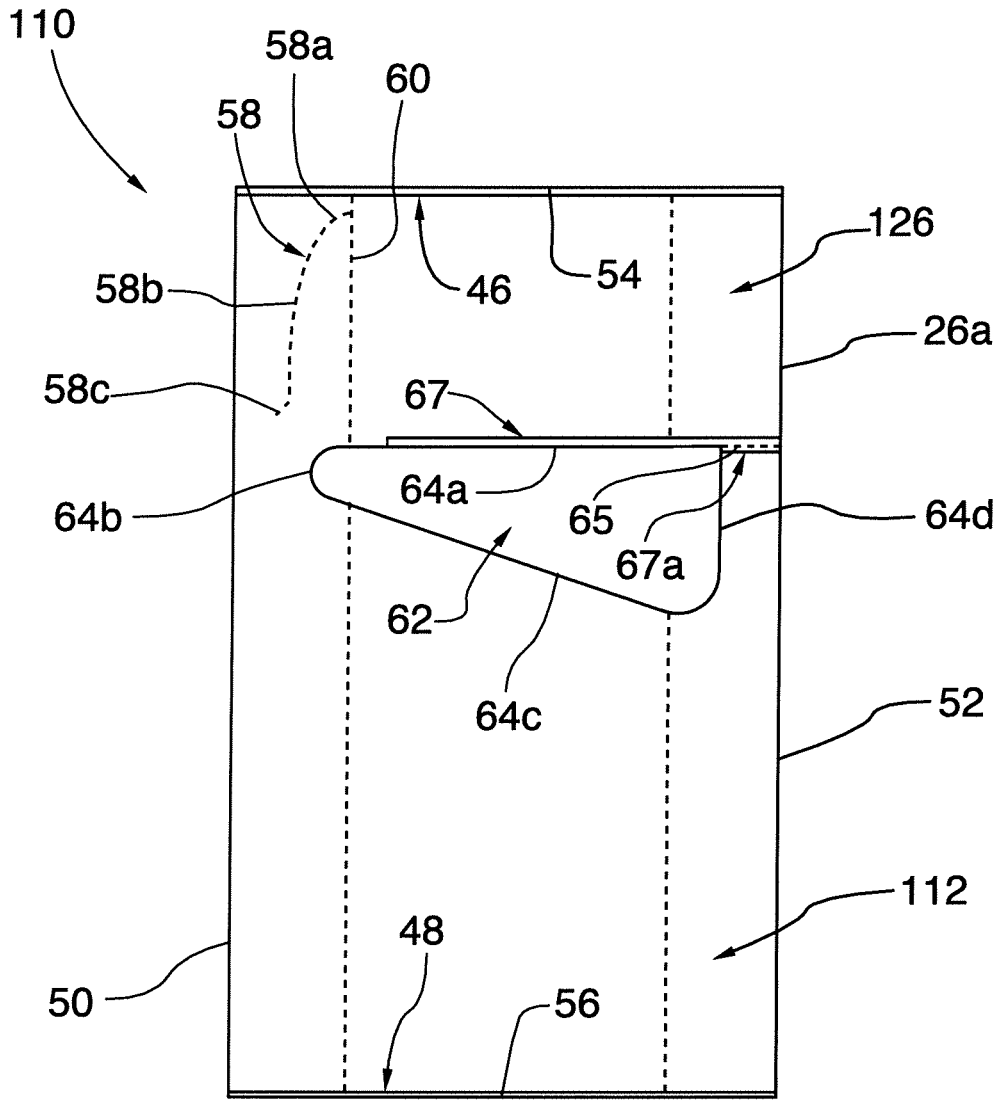
FIG. 7 is a front side elevational view of a second embodiment of the sanitary collection device, illustrating same in a flat web form received from the manufacturer.
Figure 8:
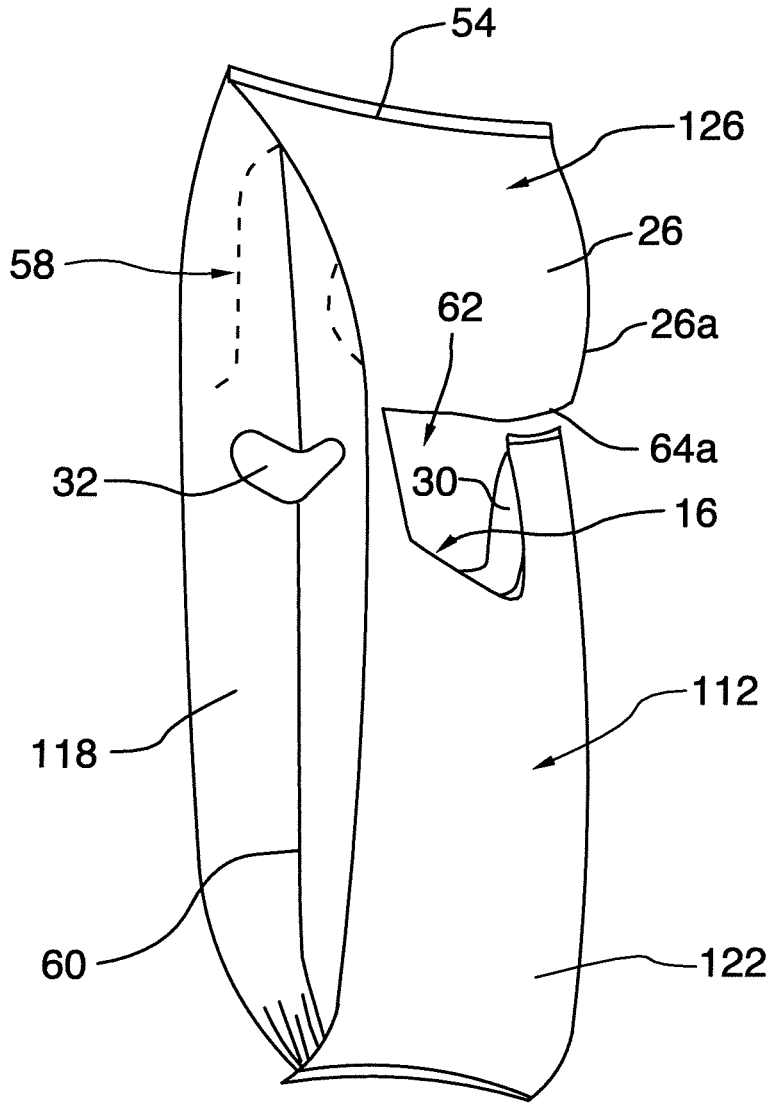
FIG. 8 is a side perspective view of the second embodiment sanitary collection device when expanded from its initially flat web form during preparation for use.
Figure 9:
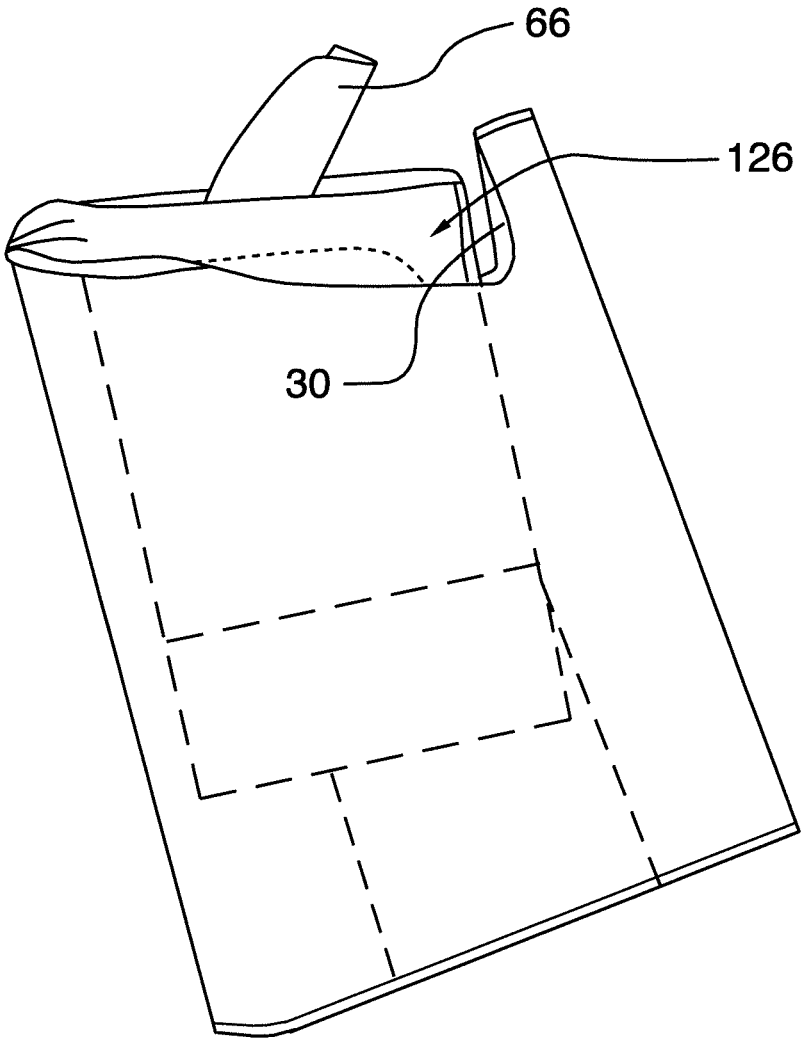
FIG. 9 is a front side perspective view of the second embodiment sanitary collection device in a post-use position ready to tying off and disposal of the device.

FIGS. 7 through 9 illustrate an alternative embodiment of the combined bag and hand protector 110 in which the bag and the hand protector are integral parts of a unitary bag construction that can be easily produced by performing stamping operations on a plastic bag of otherwise conventional manufacture. Using conventional plastic bag manufacturing techniques, a series of bags are produced from a continuous web of plastic film. Opposing primary faces of the web respectively define the front and rear walls of each bag, while in-folded panels of the web lie in sandwiched relation between the front and rear faces of the web to later define side walls of the finished bags when expended into usable form. During this manufacturing process, the continuous web is stamped with a cutting or perforating die at regular intervals to either pre-cut the individual bags from one another, or to provide perforated separation lines at which the bags are later separable from one another by the consumer. Each bag is thus defined by a respective web section delimited between two cut or perforated separation lines. In conventional bag manufacture, each separation line is neighboured by a heat seal on one side thereof so that a bottom end of each web section is sealed closed to create the closed bottom of a respective bag. In the present invention, each separation line in the continuous web is instead neighboured by heat seals on both sides thereof to create both an upper seal 46 along a sealed top end of one web section and a lower seal 48 along a sealed bottom end of the neighbouring web section.

FIG. 7 illustrates one such web section still in its initial flat web form in which the in-folded side wall panels remain in their inwardly folded sandwiched relation between the two faces of the web. This initially flat web form of the bag construction illustrates unique stamp-formed features thereof by which the otherwise conventionally manufactured bag is provided with the hand protection sleeve when the bag construction is expanded from its initial flat web form into an expanded three-dimensional form. The web section features parallel first and second longitudinal edges 50, 52 which perpendicularly span between the sealed-closed top end 54 of the web section and the sealed-closed bottom end 56 of the web section.

A stamping operation during the manufacture of the bag uses a perforation tool to stamp a tear-out perforation line 58 through the web section at a corner area thereof between the sealed-closed top end 54 of the web section, and the first longitudinal edge 50 thereof. The tear-out perforation line 58 has a first segment 58*a* that intersects the folded mid-seam 60 of the first side wall panel of the bag that lies in inwardly folded relation from the first longitudinal edge 50 of the web, and extends outwardly from this folded mid-seam 60 toward the first longitudinal edge 50 of the web. A second segment 58*b* of the tear-out perforation line 58 spans longitudinally from the first segment toward the sealed bottom end 56 of the web over only a fractional portion of the web's length. An optional final segment 58*c* of the tear-out perforation line 58 may curve outwardly from a bottom end of the second segment 58*c* toward, but stopping short of, the first longitudinal edge 50 of the web.

In addition to the perforation tool, the stamping operation also employs a cutting tool to stamp an open void 62 through the front and rear faces of the web section at an area thereof situated between the sealed bottom end of the web section and the lowermost point of the tear-out perforation line 58. The void 62 resides nearer to the sealed top end 54 of the web section than to the sealed bottom end 56 thereof. The void 62 partially overlaps of each the inwardly folded-side wall panels, but stops short of the longitudinal outer edges 50, 52 of the web section.

The cut perimeter boundary of the void 62 features a top boundary edge 64*a* residing nearest to the top end 54 of the web section, but in notably spaced relation therefrom. This top boundary edge 64*a* of the void thus spans transversely across a less-than-full width of the web section from near one longitudinal edge of the web section 50 to near the other longitudinal edge 52 thereof. An extension 65 of the void's top boundary edge 64*a* continues outwardly beyond the void 62 in one direction to intersect with the second longitudinal edge 52 of the web section. This extension 65 may be a cut line, or as shown, may be a perforated line to later be torn by the end user.

Near the first longitudinal edge 50 of the web section, the cut perimeter boundary of the void features a curved transition edge 64*b* spanning an arc of slightly less than 180 degrees from the top boundary edge 64*a* toward the sealed bottom end of the web section. From this transition edge 64*b*, a bottom boundary edge 64*c* of the void 62 spans back toward the second longitudinal edge 52 of the web in oblique relation to the top boundary edge 64*a*, which lies perpendicularly of the web's longitudinal edges 50,52. At an end of the bottom boundary edge 64*c* near, but spaced inwardly from, the second longitudinal edge 52 of the web, the perimeter boundary of the void 62 is completed by a final boundary edge 64*d* that spans longitudinally between the top and bottom boundary edges 64*a*, 64*c* of the void 62. The void 62 divides the web section into a lower bag portion 112 situated between the void and the sealed bottom end 56 of the section, and an upper hand protector portion 126 disposed between the void 62 and the sealed top end 54 of the section.

The front and rear faces of the web section are sealed together over a substantial length of the top boundary edge 64*a* of the void 62 from near the curved transition edge thereof 64*b*. This seal 67 continues from the end of the top boundary edge 64*a* along the top boundary edge extension 65 to the second longitudinal edge 52 of the web section, and is accompanied by a shorter seal 67*a* situated across the extension 65 from the longer seal 67 to span along the extension 65 from the void's final boundary edge 64*d* to the second longitudinal edge 52 of the web section. The front and rear faces of the web section are not sealed together around the rest of the void's perimeter boundary at the transition edge 64*b*, lower edge 64*c* and final boundary edge 64*d*.

FIG. 8 shows the bag construction of FIG. 7 when expanded by the end-user into its three-dimensional form in preparation for use. Here, the front and rear faces of the lower bag portion of the web section are pulled away from one another to create the front wall 122 and opposing rear wall of the bag. This separation of the front and rear walls also acts to unfold the first side panel of the web to form the taller first side wall 118 of the bag, and likewise acts to unfold the portion of the second side wall panel below the void 62 to form the shorter second side wall of the bag. The unsealed lower boundary 64*c* of the void 62 now denotes the open top end of a collection space that is delimited below the void 62 by the front, rear and side walls of the bag, and whose closed bottom is defined by the sealed bottom end 56 of the web section. The unsealed portion of the void 62 cut through the second side wall panel of the web section at the void's final boundary edge 64*d* forms the handle opening 30 in the second side wall of the bag. The bottom seal running 67*a* along the top boundary edge extension 65 of the web section forms the closed top of the handle loop above the handle opening 30. The portion of the void 62 cut through the first side wall panel of the web section at the void's transitional boundary edge 64*b* forms another handle opening 32 in the first side wall 118 of the bag at an area thereof below the tear-out perforation line 58.

At the upper hand protector portion 126 of the bag construction, tear-out perforation line 58 perforates both halves of the unfolded first side wall 118 in symmetrical relation across the previously folded mid-seam 60 thereof. A tear-out area of the first side wall 118 is delimited between the two symmetric halves of the perforation line 58, and is torn out from the intact remainder of the side wall during preparation of the bag for use. This performs two functions. Firstly, the torn-out area of the taller first side wall 118 creates an open end of a flexible sleeve 26 that is delimited between the sealed-closed top end 54 of the web section, and a lower seam of the sleeve defined by the seal 67 running along the top boundary edge 64*a* of the void 62 and the top boundary edge extension 65. If the extension 65 is a perforated line, the user tears the upper sleeve portion and lower bag portion apart along this line to separate the sleeve from the handle loop of the second side wall of the bag. Secondly, the torn-out area of the first side wall 118 remains connected to the intact lower remainder of the side wall 118 because the two symmetric halves of the perforation line 58 are not joined at their bottom ends. As a result, the torn-out area forms an integrally attached tie member 66 that, as shown in FIG. 9, can be tied to the handle 30 of the shorter second wall when the device has been used for waste collection, and is ready for disposal.

The upper end of the second in-folded side wall panel of the web section forms the closed distal end 26*a* of the sleeve 26 opposite the torn-open end thereof at the taller first side wall 118. The in-folded state of this upper end of the side wall panel creates a gusset for better lining of the user's palm for improved dexterity and grip during the collection process.

The second embodiment thus provides a unique bag structure and method of bag manufacture by which a sleeve-shaped hand protector and collection bag are formable integrally and efficiently in a continuous web of plastic film using sealing, cutting and perforation tools in a stamping operation performed on the web, thereby avoiding the need for seaming together of separately fabricated bag and hand protector components. Accordingly, use of the term "attached" herein when describing the sleeve as attached to the side wall of the bag is meant to encompass both the formation of these components as integral parts of a unitary whole, as demonstrated by the second embodiment, or seaming or other fastening together of two initially separate components into an assembled whole, as demonstrated by the first embodiment.

In the illustrated example of the second embodiment, the void is pre-cut from the web section by the manufacturer, and so the boundary edges 64*a*, 64*b*, 64*c*, 64*d* of the void are cut lines along at which an area of the web section has been fully severed and removed at the manufacturing stage. In an alternative embodiment, these cut boundary edges may be replaced with perforated boundary lines delimiting an area of the web section that is later torn out along the perforated boundary lines by the end-user to create the void 62 when it comes time to use the product. Accordingly, the expression "stamped void area" is used to encompass both an open space from which an originally present piece of the web section has been previously removed during manufacture of the article, and a perforation-delimited area to later be torn out from the remainder of the web section by the end user. The boundaries of such void area may therefore be pre-cut boundary edges around an already open void space, intact perforation lines around an intact piece of the web not yet removed, or torn perforation lines along which the initially intact web piece has already been removed to create the open void space.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A device for sanitary collection of materials, said device comprising a bag having a closed bottom end, and side walls that extend from the closed bottom end to delimit a collection space between said walls above the closed bottom end of the bag, and a hand protector that is attached to one of said side walls and has a hollow interior that is open or openable at one end to enable insertion of one's hand into said hollow interior of the hand protector, wherein said one of the side walls to which the hand protector is attached is a taller side wall that reaches a greater height from the closed bottom of the bag than a lesser height possessed by at least one other of said side walls, and the hand protector is attached to said taller one of the side walls at an elevation thereon that exceeds said lesser height possessed by said at least one other of said side walls.

2. The device of claim 1 wherein the taller side wall is a tallest side wall of greater height than all other of the side walls.

3. The device of claim 1 wherein the bag comprises a handle at an opposing one of the side walls that resides opposite said taller side wall, and said taller side wall is taller than said opposing one of the side walls.

4. The device of claim 1 wherein the hand protector is a fingerless hand protector.

5. The device of claim 1 comprising a tie member externally attached to the same taller side wall as the hand protector.

6. The device of claim 5 wherein said tie member is attached to the taller side wall of the bag at a lower elevation thereon than an opening of the hand protector.

7. The device of claim 1 wherein the taller side wall is taller than an opposing one of the side walls that resides opposite said taller side wall.

8. The device of claim 1 wherein the taller side wall is taller than a front one of the side walls, which resides in non-opposing relation to said taller side wall.

9. The device of claim 8 wherein the front one of the side walls is shorter than another one of the side walls that resides opposite the taller side wall.

10. The device of claim 9 wherein the bag comprises a handle at said another one of the side walls.

11. The device of claim 9 wherein a rear one of the side walls resides opposite to the front one of the side walls, and is equal in height thereto.

12. A device for sanitary collection of materials, said device comprising a bag having a closed bottom end, and side walls that extend from the closed bottom end to delimit a collection space between said side walls above the closed bottom end of the bag, and a hand protector attached to a first one of said side walls and comprising a hollow interior that is open or openable at one end to enable insertion of one's hand into said hollow interior of the hand protector, wherein the bag and the hand protector are integral parts of a unitary bag construction having a stamped void area therein that divides the bag into a lower collection portion that resides below the stamped void area and comprises said side walls and the collection space delimited therebetween, and an upper hand-protection portion that resides above said stamped void area and comprises said hand protector; wherein a perimeter boundary of the void comprises a sealed boundary region at which two opposing sides of the bag are sealed together along a top boundary edge of said stamped void to define a bottom seam of the hand protector, and an unsealed boundary region that spans along a lower boundary edge of said stamped void and at which said two opposing sides of the bag are left unsealed from one another to define an open upper end of the collection space.

13. The device of claim 12 wherein the unitary bag construction comprises a perforated area in the first one of said side walls by which an opening to the hand protector at said one end thereof is openable by tearing of said perforated area.

14. The device of claim 13 wherein a perforation line of said perforated area has an open-ended path to leave said perforated area connected to the side wall to form a tie-member by which the connection space can be tied closed.

15. The device of claim 13 wherein the lower boundary edge lies in obliquely oriented relation to the top boundary edge.

16. A product for forming a bag useful for sanitary collection of materials, said product comprising a web of plastic film having opposing primary faces, at least one section of said web comprising a stamped void area with a perforated or cut perimeter boundary that spans fully there-around and penetrates or perforates through said primary faces of the web, said stamped void area dividing said section into an upper portion situated between said stamped void area and a sealed upper end of said section, and a lower portion situated between said stamped void area and a sealed lower end of said section, the perimeter boundary of said stamped void area comprising a sealed boundary region at which the opposing primary faces of the web are sealed together in a direction spanning cross-wise to the web along a top boundary edge of the stamped void area at a location nearer to the sealed upper end of said section than to the sealed lower end thereof, and an unsealed boundary region at which said primary faces are left unsealed from one another and which spans cross-wise to the web along a lower boundary edge of the stamped void area at a location between the sealed boundary region and the sealed lower end of said section, wherein either the perimeter boundary is pre-cut and the stamped void area is thus pre-removed, or the perimeter boundary is perforated and the stamped void area is thus configured for torn removal, whereby absence or removability of the stamped void area is operable to establish an open void in the section, below which the unsealed relationship between the primary faces of the web at the boundary region serves to form an upper access opening of a collection space delimited below said void and above the sealed bottom end of the section between the primary faces of the webbing when pulled apart, and above which the sealed together condition of the primary faces at the sealed boundary region serves to form a bottom seam of a hand protector delimited between said sealed upper boundary region and the sealed upper end of the section.

17. The product of claim 16 comprising a perforated area in the upper portion of the section adjacent one longitudinal edge of the webbing for selective torn removal of said perforated area to create an opening to the hand protector at one end thereof.

18. The product of claim 16 wherein the web comprises in-folded side panels between the primary faces, and the perimeter boundary of the stamped void area penetrates or perforates through at least one of the in-folded side panels to define a handle opening a side wall of the bag that is formed by unfolding of said one of the in-folded side panels.

19. The product of claim 16 wherein a cut or perforated extension of the top boundary edge of the stamped void area extends to a longitudinal edge of the webbing to separate one end of the hand protector from a corresponding side wall of the resulting bag at one side of the collection space thereof.

20. The product of claim 16 wherein the lower boundary edge and unsealed boundary region spanning therealong lie in obliquely oriented relation to the top boundary edge and the sealed boundary region spanning therealong.

* * * * *